US010925462B2

(12) United States Patent
Detko

(10) Patent No.: US 10,925,462 B2
(45) Date of Patent: Feb. 23, 2021

(54) WASHING AGENT DISPENSING DEVICE, PARTICULARLY FOR A DISHWASHING MACHINE

(71) Applicant: BITRON POLAND SP. Z O.O, Sosnowiec (PL)

(72) Inventor: Lukasz Detko, Niegowonice (PL)

(73) Assignee: BITRON POLAND SP. Z O.O., Sosnowiec (PL)

( * ) Notice: Subject to any disclaimer, the term of this patent is extended or adjusted under 35 U.S.C. 154(b) by 162 days.

(21) Appl. No.: 16/152,940

(22) Filed: Oct. 5, 2018

(65) Prior Publication Data

US 2019/0104914 A1 Apr. 11, 2019

(30) Foreign Application Priority Data

Oct. 9, 2017 (PL) ..... P.423111

(51) Int. Cl.
*A47L 15/44* (2006.01)

(52) U.S. Cl.
CPC ..... *A47L 15/44* (2013.01)

(58) Field of Classification Search
CPC .. A47L 15/44; A47L 15/4409; A47L 15/4418; A47L 15/4436; A47L 15/4463; A47L 15/449
See application file for complete search history.

(56) References Cited

U.S. PATENT DOCUMENTS 5,931,330 A * 8/1999 Starr ..... B65F 1/1615 220/254.3
2005/0103365 A1* 5/2005 Cerruti ..... A47L 15/4409 134/93
2005/0115595 A1* 6/2005 Cerruti ..... A47L 15/4409 134/93

FOREIGN PATENT DOCUMENTS

WO WO-2016091822 A1 * 6/2016 ..... F03G 7/065

* cited by examiner

*Primary Examiner* — David G Cormier
(74) *Attorney, Agent, or Firm* — Sughrue Mion, PLLC

(57) ABSTRACT

A dispensing device (1) for a dishwashing machine, the dispensing device (1) including: a body (2) configured to be mounted to a door of the dishwashing machine; a receptacle (3) formed in the body (2) to receive a quantity of a washing or rinsing agent; a movable lid (5) associated with the receptacle (3) and displaceable in a manner constrained to the body (2) against the action of a spring (8) from an open position into a closed position, where it opens and closes the receptacle (3), respectively; a gasket (6) arranged on the lid and a sealing projection (4) arranged on the body, the gasket having a sealing surface (6*c*) engaged by the sealing projection (4) when the lid (5) is in closed position, in such a way as to provide a seal around the receptacle (3); and a latching apparatus (11, 13) provided for locking the lid (5) in the closed position and operable to release the lid (5) from the closed position. The sealing surface (6*c*) of the gasket (6) has a curved cross-sectional profile over the entire length of the gasket (6), having a convexity facing towards the sealing projection (4).

6 Claims, 2 Drawing Sheets

WASHING AGENT DISPENSING DEVICE, PARTICULARLY FOR A DISHWASHING MACHINE

BACKGROUND OF THE INVENTION

Field of the Invention

The present invention relates to a dispensing device for a washing and/or rinsing agent, in particular a dispensing device to be mounted to a wall of a door which faces a washing chamber of a dishwashing machine.

More specifically, the present invention relates to a dispensing device comprising:

- a body configured to be mounted to a door of the dishwashing machine on the side directed during operation towards a washing chamber of said dishwashing machine;
- at least one receptacle formed in the body and intended to receive a quantity of a washing or rinsing agent;
- at least one movable lid associated with said at least one receptacle and displaceable in a manner constrained to the body against the action of resilient return means from an open position into a closed position, where it opens and closes the receptacle, respectively;
- a gasket arranged on one of said lid and body and a sealing projection arranged on the other of said lid and body, said gasket having a sealing surface engaged by the sealing projection when the lid is in closed position, in such a way as to provide a seal around the receptacle; and
- a latching apparatus provided for locking the lid in the closed position and operable to release the lid from the closed position.

Background

In known solutions of dispensing devices it may happen that the gasket, when engaged and compressed by the sealing projection, creates a significant resistant force which negatively affects the closure process. Furthermore, in solutions in which the lid is configured to perform a sliding motion, the gasket may cause friction and resistance to the motion of the lid.

One object of the present invention is to provide a configuration for a dispensing device in which the above mentioned drawbacks are at least partially reduced.

SUMMARY OF THE INVENTION

This and other objects are achieved according to the invention with a dispensing device of the type initially specified, characterised in that the sealing surface of the gasket has a curved cross-sectional profile over the entire length of the gasket, having a convexity facing towards the sealing projection.

According to the invention, the gasket provides a soft "cushion" sealing surface which at least partially relieves the drawbacks of conventional gaskets with flat sealing surface.

BRIEF DESCRIPTION OF THE DRAWINGS

Further features and advantages of the present invention will become apparent from the following detailed description, which is given purely by way of a non-limiting example, with reference to the attached drawings, wherein.

DETAILED DESCRIPTION OF THE INVENTION

Figure 1:
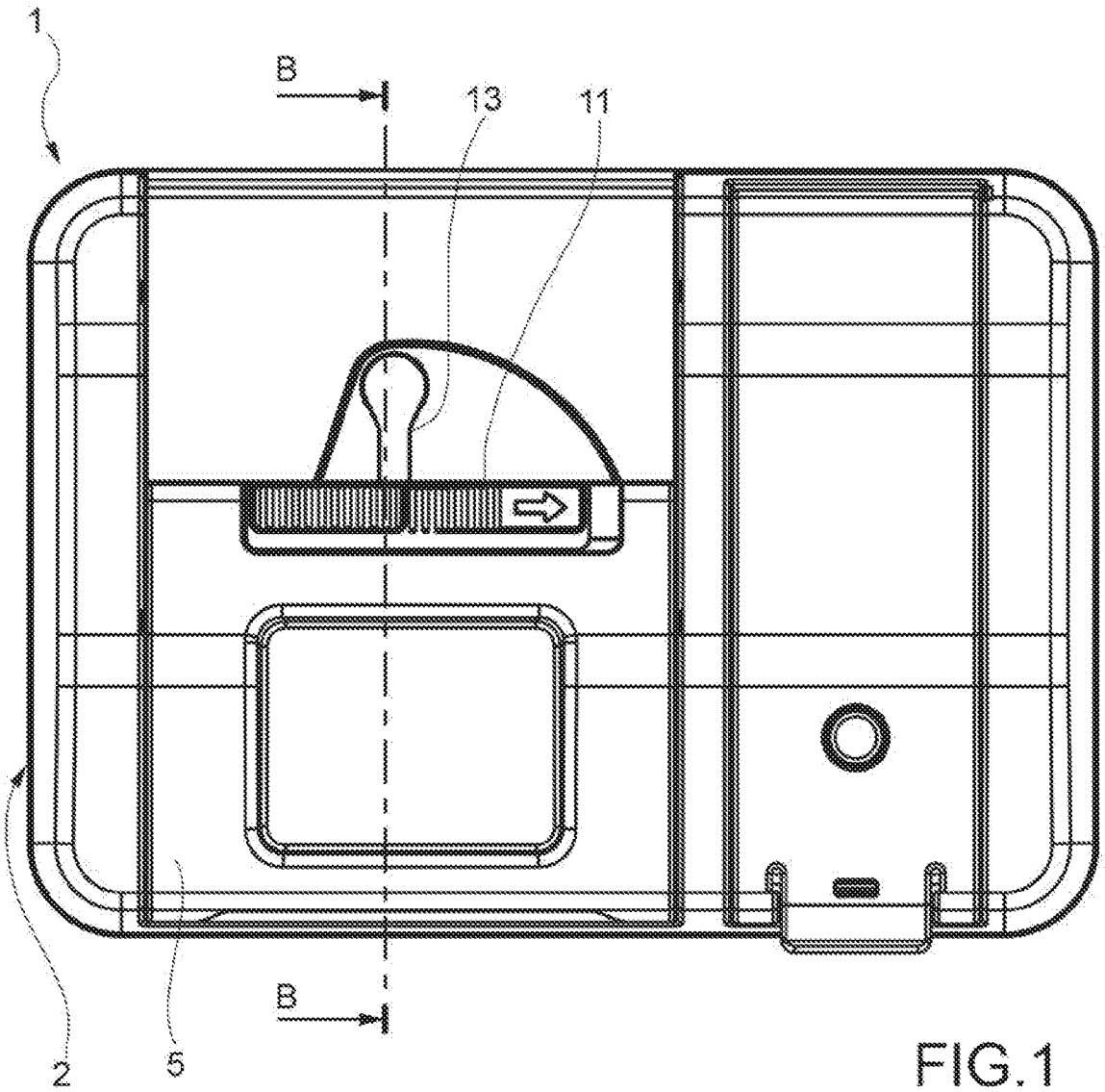
FIG. 1 is a plan view of a dispensing device according to the present invention.
Figure 2:
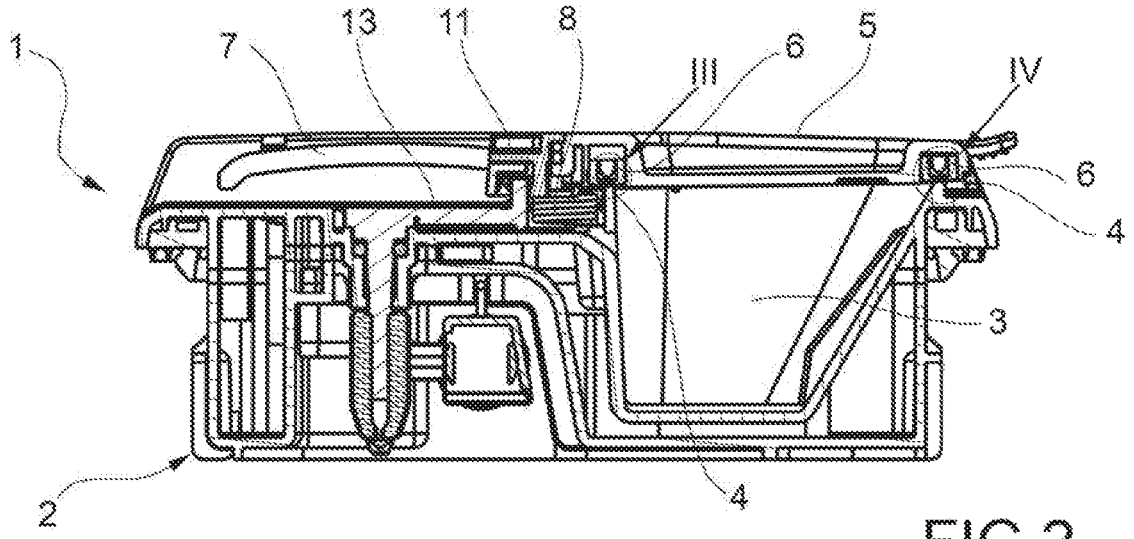
FIG. 2 is a sectioned view of the dispensing device of FIG. 1, taken along the line B-B.

In the drawings, the reference number 1 indicates the whole of an integrated dispensing device including a dispenser of washing agent or detergent according to the present invention.

In a per se known manner, such an integrated dispensing device 1 is intended to be fixed to an inner wall of a door delimiting a washing chamber of a dishwashing machine.

Although the attached drawings show an integrated dispensing device also comprising a dispenser of rinse agent or rinse aid, the present invention is not limited to the embodiment of the washing agent dispenser in a form in which it is integrated with such a further dispenser of rinse agent.

The dispensing device 1 comprises a body 2, for example made of moulded plastic, which is intended to be connected (in a manner known per se and not shown) to the door of the dishwashing machine on the side directed during operation towards the washing chamber of this dishwashing machine.

The body 2 comprised a recessed receptacle 3, essentially in the form of a tray. The receptacle 3 is intended to receive a quantity of washing agent, such as a powder detergent or a liquid detergent or a solid washing agent in the form of "soap bar" or tablet. The edge of the receptacle 3 is provided with a peripheral projection or rim 4.

The device 1 comprises a movable lid 5 which is associated with the receptacle 3 and is connected to the body 2. The movable lid 5 is displaceable in a manner constrained to the body 2 between a closed position (FIG. 1) and an open position (not shown), where it sealingly closes and opens the receptacle 3, respectively. The lid 5 comprises a gasket 6 arranged on its side facing towards the receptacle 3, which in the closed position is engaged by the peripheral projection 4 surrounding the receptacle 3. However, alternative arrangements are possible; for example, the peripheral projection may be formed on the lid, and the gasket may correspondingly be arranged around the receptacle.

As shown in FIGS. 3 to 6, the gasket 6 has a cross-sectional shape that is substantially constant over the entire length of the gasket 6. In particular, the gasket 6 is substantially U-shaped or channel-shaped in cross-section, and comprises a pair of flange portions 6*a* interconnected by a web portion 6*b*. A sealing surface 6*c* is formed on the web portion 6*b* on the side thereof intended to be engaged by the sealing projection 4 when the lid 5 is in closed position. The sealing surface 6*c* of the gasket 6 has a cross-sectional profile that is curved, having a convexity facing towards the sealing projection 4 when the lid is close to the closed position. Of course, these statements concerning the profile of the sealing surface 6*c* of the gasket are referred to a normal condition, i.e. a condition in which the gasket 6 is still not compressed by the sealing projection 4.

Figure 3:
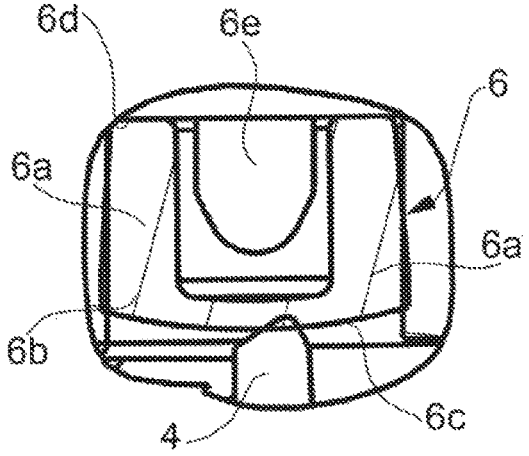
FIGS. 3 and 4 are enlarged views of details of the dispensing device, indicated by arrows III and IV in FIG. 2.
Figure 4:
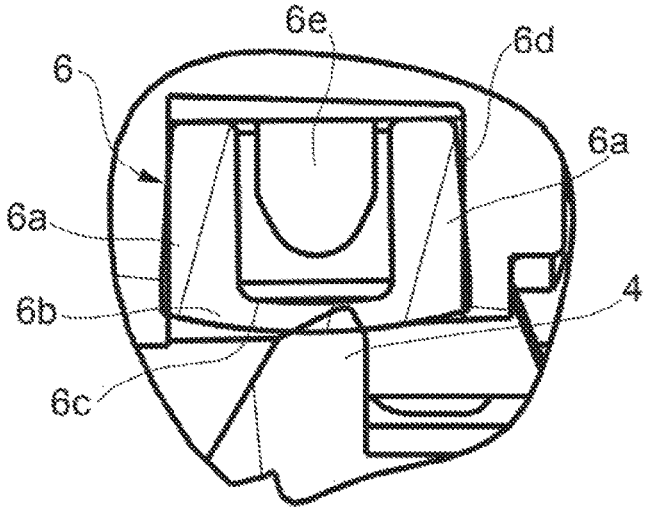
Figure 5:
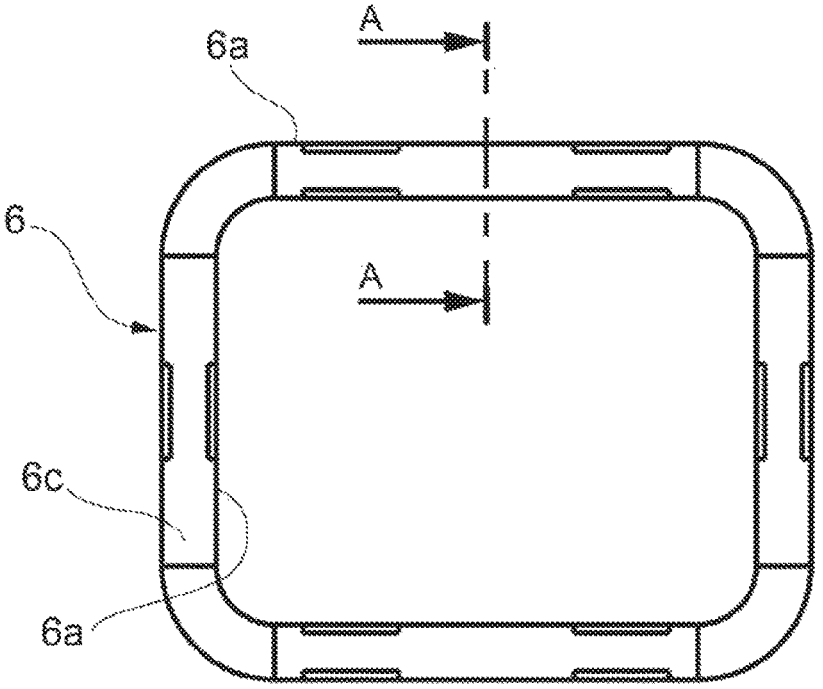
FIG. 5 is a plan view of a gasket of the dispensing device.
Figure 6:
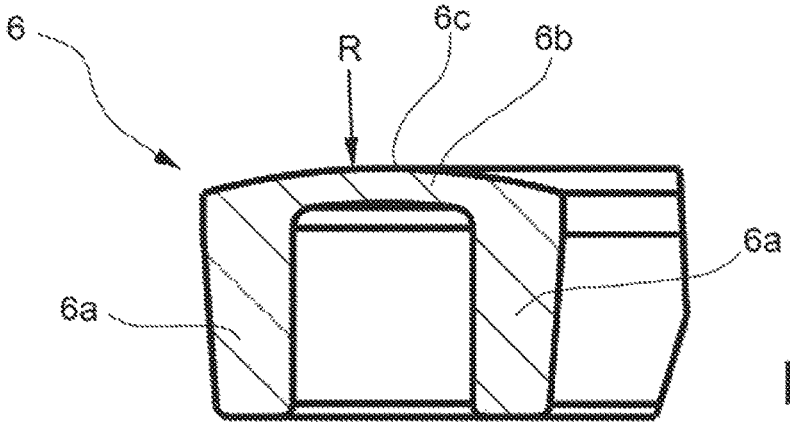
FIG. 6 is a sectioned view of the gasket, taken along the line A-A of FIG. 5.

As shown in FIGS. 3 and 4, the gasket 6 is received in a grooved seat 6*d*, which in the example shown in the drawings is formed in the lid 5. A rib 6*e* is optionally formed on the bottom of the grooved seat 6*d*, which is inserted into a hollow formed in the gasket 6 behind the sealing surface 6*c*.

The lid 5 comprises, on each of its lateral sides, a pair of pins (not shown) integrally formed with the lid 5 and slidably arranged in respective grooves 7 formed in the body 2 of the dispenser 1. Therefore, the slid shown in the drawings is configured to perform a sliding motion between the closed and open positions. However, alternative configurations are possible, such as for example a configuration in which the lid is rotatable around a fixed axis.

A resilient return member, such as a spring 8, is associated with the lid 5, said return member tending to cause the latter to slide towards the open position. This return spring may be, for example, a torsion spring.

When the movable lid 5 is situated in the closed position (FIG. 1), a latching apparatus keeps it in this position against the action of the return spring 8 which would tend to bring it back into the open position. This latching apparatus may comprise a resiliently biased latching member (not shown) arranged on the lid 5 and fixedly connected to a manually operated opening member 11, as well as an automatically controlled striker member 13 arranged on the body 2 and operatively connected to an electrically controlled actuator (not shown).

The latching apparatus is provided for locking the lid 5 in the closed position and is operable to release the lid 5 from the closed position, either manually, by operating the opening member 11 with a finger of the user, or automatically, by controlling the actuator associated with the striker member 13. The constitution of the latching apparatus is not essential for the purposes of the present invention.

In the example shown in the drawings, the above described gasket is applied only to the lid 5 associated to the receptacle for the washing agent. In further embodiments, this gasket can be applied also to a lid associated to a receptacle for the rinsing agent.

Clearly, provided that the principle of the invention is retained, the forms of construction and the details of embodiment can be varied widely from what has been described herein purely by way of a non-limiting example, without thereby departing from the scope of the invention as defined by the attached claims.

The invention claimed is:

1. A dispensing device for a washing and/or rinsing agent, said dispensing device comprising:

a body configured to be mounted to a door of a dishwashing machine on the side directed during operation towards a washing chamber of said dishwashing machine;

at least one receptacle formed in the body and intended to receive a quantity of a washing or rinsing agent;

at least one movable lid associated with said at least one receptacle and displaceable in a manner constrained to the body against the action of a resilient return member from an open position into a closed position, where said at least one movable lid opens and closes said at least one receptacle, respectively;

a gasket arranged on one of said at least one movable lid and body and a sealing projection arranged on the other of said at least one movable lid and body, said gasket having a sealing surface engaged by the sealing projection when said at least one movable lid is in closed position, in such a way as to provide a seal around said at least one receptacle; and a latching apparatus provided for locking said at least one movable lid in the closed position and operable to release said at least one movable lid from the closed position;

wherein the sealing surface of the gasket has a curved cross-sectional profile over the entire length of the gasket, having a convexity facing towards the sealing projection, wherein the gasket is received in a grooved seat, wherein a rib is formed on a bottom of the grooved seat, said rib being inserted into a hollow formed in the gasket behind the sealing surface, wherein said hollow is greater in cross-sectional area than the rib.

2. A device according to claim 1, wherein the cross-sectional profile of the sealing surface of the gasket is substantially constant over the entire length of the gasket.

3. A device according to claim 2, wherein the gasket has a cross-sectional shape that is substantially constant over the entire length of the gasket.

4. A device according to claim 1, wherein the gasket is substantially U-shaped or channel-shaped in cross-section.

5. A device according to claim 1, wherein said hollow is wider than the rib.

6. A device according to claim 1, wherein a ridge of the rib is at a distance from a bottom of the hollow.

* * * * *